US010485328B2

(12) United States Patent
Jimenez et al.

(10) Patent No.: US 10,485,328 B2
(45) Date of Patent: Nov. 26, 2019

(54) ORAL CARE IMPLEMENT

(71) Applicant: Colgate-Palmolive Company, New York, NY (US)

(72) Inventors: Eduardo Jimenez, Manalapan, NJ (US); Kenneth Waguespack, North Brunswick, NJ (US); Douglas Hohlbein, Hopewell, NJ (US); Anthony Baxter, Upper Montclair, NJ (US); Marisol Rodriguez, New York, NY (US); Alberto Mantilla, Rego Park, NY (US); Ellis Junior Smith, New York, NY (US); Chad Leighton Helland, New York, NY (US); Dario Alejandro Narvaez Lopez, North Bergen, NY (US); Mauricio Issa, New York, NY (US)

(73) Assignee: Colgate-Palmolive Company, New York, NY (US)

( * ) Notice: Subject to any disclaimer, the term of this patent is extended or adjusted under 35 U.S.C. 154(b) by 66 days.

(21) Appl. No.: 15/767,675

(22) PCT Filed: Oct. 12, 2015

(86) PCT No.: PCT/US2015/055056
§ 371 (c)(1),
(2) Date: Apr. 12, 2018

(87) PCT Pub. No.: WO2017/065719
PCT Pub. Date: Apr. 20, 2017

(65) Prior Publication Data

US 2018/0352945 A1 Dec. 13, 2018

(51) Int. Cl.
*A46B 9/10* (2006.01)
*A46B 9/04* (2006.01)
(Continued)

(52) U.S. Cl.
CPC ..... *A46B 9/10* (2013.01); *A46B 5/0075* (2013.01); *A46B 7/02* (2013.01); *A46B 9/04* (2013.01);
(Continued)

(58) Field of Classification Search
CPC ..... A46B 9/10; A46B 5/0075; A46B 7/02; A46B 9/04; A46B 9/045; A46B 9/06; A46B 2200/1066; A46B 2200/108
See application file for complete search history.

(56) References Cited

U.S. PATENT DOCUMENTS 1,658,706 A 2/1928 Carrot
1,796,367 A 3/1931 Grove
(Continued)

FOREIGN PATENT DOCUMENTS

DE 20020762 3/2001
DE 102013112800 12/2001
(Continued)

OTHER PUBLICATIONS

International Search Report and Written Opinion of the International Searching Authority in International Application No. PCT/US2015/055056, dated Jun. 6, 2016.

*Primary Examiner* — Weilun Lo

(57) ABSTRACT

An oral care implement having a handle, a head, and at least one movable cleaning element coupled to the head. The movable cleaning element may be used as an interdental cleaner. The movable cleaning element may be positioned within a loop formed by fixed cleaning elements on the head. The movable cleaning element may be coupled to an actuator that moves the movable cleaning element between a first position wherein a distal tip of the movable cleaning element is spaced a first distance from a front surface of the head and a second position wherein the distal tip of the movable cleaning element is spaced a second distance from the front
(Continued)

surface of the head, the second distance being greater than the first distance. The movable cleaning element may maintain the first and second positions until subsequent actuation of the actuator.

16 Claims, 10 Drawing Sheets

(51) Int. Cl.
*A46B 9/06* (2006.01)
*A46B 5/00* (2006.01)
*A46B 7/02* (2006.01)

(52) U.S. Cl.
CPC ..... *A46B 9/045* (2013.01); *A46B 9/06* (2013.01); *A46B 2200/108* (2013.01); *A46B 2200/1066* (2013.01)

(56) References Cited

U.S. PATENT DOCUMENTS

| | | | | | |
|---|---|---|---|---|---|
| 1,852,480 | A | | 4/1932 | Ruetz | |
| 1,996,205 | A | | 4/1935 | Jackson | |
| 3,680,169 | A | * | 8/1972 | Thompson | A46B 7/02 15/176.1 |
| 4,296,518 | A | | 10/1981 | Furrier et al. | |
| 4,409,701 | A | * | 10/1983 | Perches | A46B 7/02 15/106 |
| 4,783,874 | A | * | 11/1988 | Perches | A46B 7/02 15/167.1 |
| 5,327,608 | A | * | 7/1994 | Kosakewich | A46B 7/02 15/167.1 |
| 5,350,248 | A | | 9/1994 | Chen | |
| 5,350,428 | A | | 9/1994 | Leroux et al. | |
| 5,357,644 | A | * | 10/1994 | Theriault | A46B 7/02 15/167.1 |
| 5,360,026 | A | * | 11/1994 | Klinkhammer | A46B 5/002 132/308 |
| 5,373,602 | A | * | 12/1994 | Bang | A46B 5/0025 15/106 |
| D435,347 | S | | 12/2000 | Rumsey, Jr. | |
| 6,202,248 | B1 | | 3/2001 | Faires | |
| 6,993,804 | B1 | | 2/2006 | Braun et al. | |
| 7,213,293 | B1 | * | 5/2007 | Schraga | A46B 9/10 15/167.1 |
| 7,841,041 | B2 | | 11/2010 | Moskovich et al. | |
| 8,011,057 | B2 | | 9/2011 | Nejat | |
| 8,020,243 | B2 | | 9/2011 | Hupence | |
| 8,239,995 | B2 | | 8/2012 | Chenvainu et al. | |
| 8,499,402 | B1 | | 8/2013 | Arsenault | |
| 9,532,643 | B2 | | 1/2017 | Moskovich et al. | |
| 2004/0040571 | A1 | | 3/2004 | Williams et al. | |
| 2006/0075588 | A1 | | 4/2006 | Amador | |
| 2010/0306941 | A1 | * | 12/2010 | Erskine-Smith | A46B 9/026 15/167.1 |
| 2014/0053357 | A1 | * | 2/2014 | Barzel | A46B 5/0025 15/167.1 |

FOREIGN PATENT DOCUMENTS

| | | |
|---|---|---|
| GB | 398129 | 9/1933 |
| WO | 2003/001942 | 1/2003 |
| WO | 2010/076703 | 7/2010 |
| WO | 2015/087219 | 6/2015 |

* cited by examiner

ORAL CARE IMPLEMENT

BACKGROUND

A toothbrush is used to clean the teeth by removing plaque and debris from the tooth surfaces. Toothbrushes have a handle for gripping and a head which is inserted into a user's mouth for tooth and oral surface cleaning. The head typically has bristles formed of nylon and sometimes also cleaning elements formed from elastomeric materials to perform the cleaning function. Furthermore, some toothbrushes have been developed that include a tongue or soft tissue cleanser formed of an elastomeric material on the opposite surface of the head relative to the bristles. A great deal of innovation goes into the design of each toothbrush in order to have desirable aesthetic appeal while also improving the effectiveness of the toothbrush at performing its cleaning function. In current oral hygiene trends, toothbrushes are being developed that provide oral care benefits in addition to basic tooth cleaning. A need exists for a toothbrush or other oral care implement that has aesthetically pleasing and attractive features while still being effective at removing bacteria from a user's teeth and that offers an additional oral care benefit.

BRIEF SUMMARY

The present invention may be directed, in one aspect, to an oral care implement having a handle, a head, and at least one movable cleaning element coupled to the head. The movable cleaning element may be used as an interdental cleaner. The movable cleaning element may be positioned within a loop formed by fixed cleaning elements on the head. The movable cleaning element may be coupled to an actuator that moves the movable cleaning element between a first position wherein a distal tip of the movable cleaning element is spaced a first distance from a front surface of the head and a second position wherein the distal tip of the movable cleaning element is spaced a second distance from the front surface of the head, the second distance being greater than the first distance. The movable cleaning element may maintain the first and second positions until subsequent actuation of the actuator.

In one embodiment, the invention can be an oral care implement comprising: a handle and a head, the head having a front surface and an opposing rear surface; a plurality of cleaning elements extending from the front surface of the head, the plurality of cleaning elements comprising a plurality of fixed tooth cleaning elements and a movable interdental cleaning element; an actuator operably coupled to the movable interdental cleaning element to move the movable interdental cleaning element between: (1) a first position in which a distal tip of the movable interdental cleaning element is spaced a first distance from the front surface of the head; and (2) a second position in which the distal tip of the movable interdental cleaning element is spaced a second distance from the front surface of the head, the second distance being greater than the first distance; and wherein actuation of the actuator selectably alters the movable interdental cleaning element between one of the first and second positions, the movable interdental cleaning element being maintained in each of the first and second positions upon being selected after cessation of an actuation force of the actuator.

In another embodiment, the invention can be an oral care implement comprising: a handle and a head, the head having a front surface and an opposing rear surface; a plurality of cleaning elements extending from the front surface of the head, the plurality of cleaning elements comprising a subset of cleaning elements that form a loop and at least one movable cleaning element positioned within the loop; an actuator operably coupled to the movable cleaning element to move the movable cleaning element between: (1) a first position in which a distal tip of the movable cleaning element is spaced a first distance from the front surface of the head; and (2) a second position in which the distal tip of the movable cleaning element is spaced a second distance from the front surface of the head, the second distance being greater than the first distance.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
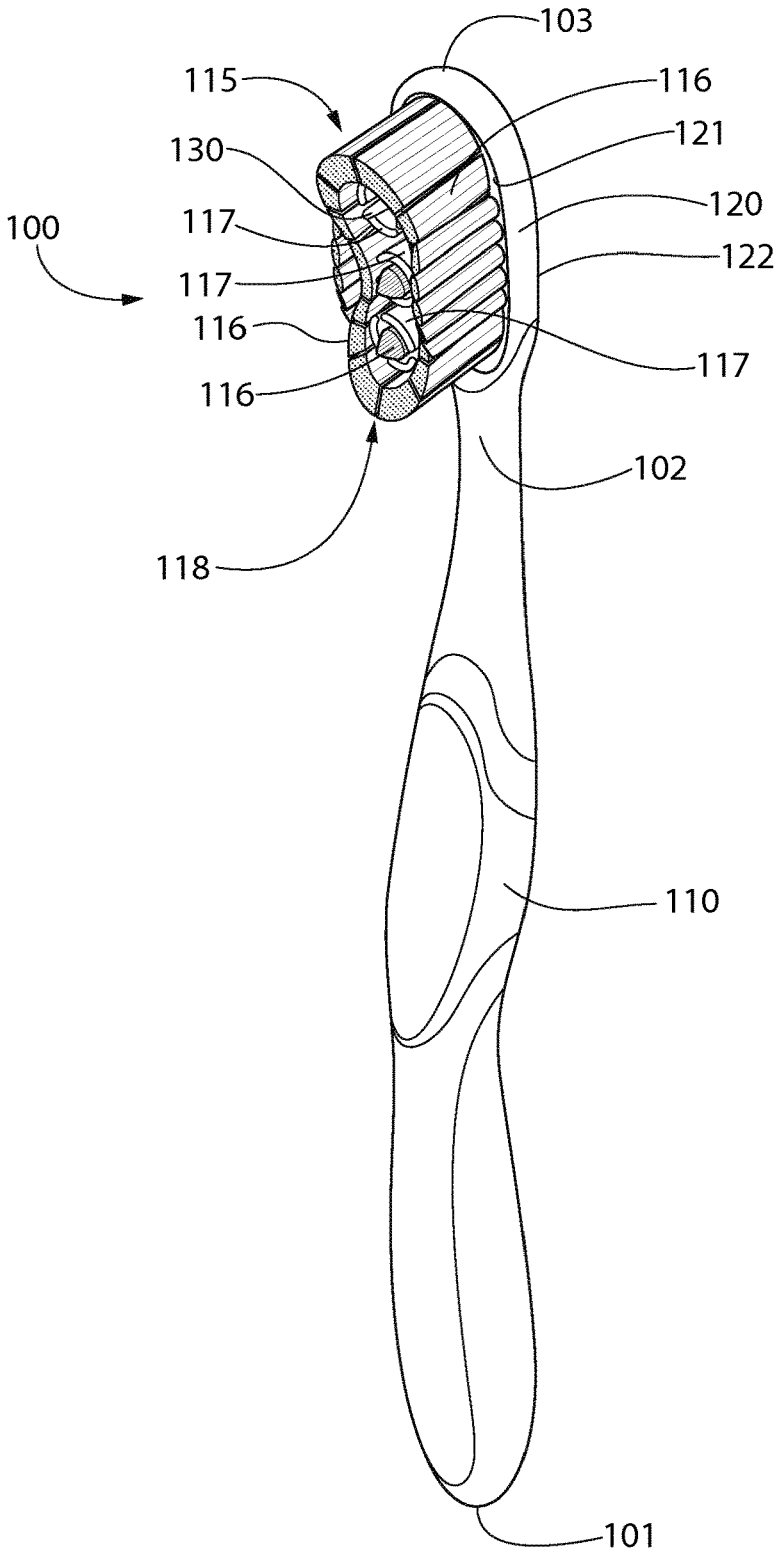
FIG. 1 is a front perspective view of an oral care implement having a movable cleaning element in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Referring first to FIG. 1, an oral care implement 100 is illustrated in accordance with one embodiment of the present invention. In the exemplified embodiment, the oral care implement 100 is in the form of a manual toothbrush. However, in certain other embodiments the oral care implement 100 can take on other forms such as being a powered toothbrush, a tongue scraper, a gum and soft tissue cleanser, a water pick, an interdental device, a tooth polisher, a specially designed ansate implement having tooth engaging elements, or any other type of implement that is commonly used for oral care. Furthermore, in still other embodiments the implement may not be limited to one that is used for oral care, and may be any type of personal care implement such as a manual or electric razor, a hairbrush, or the like. Thus, it is to be understood that the inventive concepts discussed herein can be applied to any type of oral or personal care implement unless a specific type of oral or personal care implement is specified in the claims.

In the exemplified embodiment, the oral care implement 100 comprises a handle 110 and a head 120. The handle 110 extends from a proximal end 101 of the oral care implement 100 to a distal end 102 of the handle 110. Thus, in the exemplified embodiment the handle 110 includes the portion of the oral care implement 100 that is gripped during use and a neck of the oral care implement 100 that forms the transition region between the handle 110 and the head 120. The handle 110 is an elongated structure that provides the mechanism by which the user can hold and manipulate the oral care implement 100 during use. In the exemplified embodiment, the handle 110 is generically depicted having various contours for user comfort. Of course, the invention is not to be limited by the specific shape illustrated for the handle 110 in all embodiments and in certain other embodiments the handle 110 can take on a wide variety of shapes, contours, and configurations, none of which are limiting of the present invention unless so specified in the claims. The handle 110 may be formed of one or more rigid plastic materials such as for example without limitation polymers and copolymers of ethylene, propylene, butadiene, vinyl compounds, polyesters such as polyethylene terephthalate (PET), styrene-acrylonitrile (SAN), polyurethane, polyamide, cellulosic, acrylic, acrylonitrile butadiene styrene (ABS), or the like. An thermoplastic elastomer or other elastomeric material may be overmolded or otherwise adhered/affixed to the handle 110 to enhance the grip-ability of the handle 110 and prevent hand slippage during use.

The head 120 of the oral care implement 100 is coupled to the handle 110 and comprises a front surface 121 and an opposing rear surface 122. The head 120 extends from the distal end 102 of the handle 110 to a distal end 103 of the head 120. In the exemplified embodiment, a plurality of cleaning elements 115 are coupled to and extend from the head 120, and more specifically from the front surface 121 of the head 120. The term "cleaning elements" is used in a generic sense to refer to any structure that can be used to clean, polish, or wipe the teeth and/or soft oral tissue (e.g. tongue, cheek, gums, etc.) through relative surface contact. Common examples of "cleaning elements" include, without limitation, bristle tufts, filament bristles, fiber bristles, nylon bristles, spiral bristles, tapered bristles, rubber bristles, elastomeric lamella, elastomeric protrusions, flexible polymer protrusions, combinations thereof and/or structures containing such materials or combinations. The cleaning elements may include tapered bristles, non-tapered (i.e., end rounded) bristles, and combinations thereof. Any combination of the various types of tooth cleaning elements may be used on the oral care implement 100 in different embodiments. Some specific arrangements of the cleaning elements 115 are described herein as forming a part of an exemplary embodiment of the oral care implement 100.

In the exemplified embodiment, the plurality of cleaning elements 115 comprises a plurality of tooth cleaning elements 118 and at least one movable cleaning element 130. Although in the exemplified embodiment the movable cleaning element 130 is a single cleaning element, it may be more than one cleaning element in other embodiments. In the exemplified embodiment the plurality of tooth cleaning elements 118 includes bristle tufts 116 and elastomeric elements 117. Of course, in some embodiments the tooth cleaning elements 118 may include only bristle tufts 116 without also including elastomeric elements 117 and vice versa. In certain embodiments the plurality of tooth cleaning elements 118 are fixed to the head 120 or non-movable relative to the head 120 and the at least one movable cleaning element 130 is movable relative to the head 120 as described in more detail below. More specifically, in such embodiments the plurality of tooth cleaning elements 118 have distal tips that are located at a fixed distance from the front surface 121 of the head 120 and a distance between a distal tip of the movable cleaning element 130 and the front surface 121 of the head 120 may be adjusted to achieve a specific type of oral hygiene activity. In certain embodiments the plurality of tooth cleaning elements 118 may be referred to herein as fixed tooth cleaning elements and the at least one movable cleaning element 130 may be referred to herein as an interdental cleaning element. In certain embodiments the tooth cleaning elements 118 are intended to clean the surfaces of a user's teeth and the movable cleaning element 130 is intended to clean the spaces between a user's teeth either before or after tooth brushing as described herein below.

When included on the head 120, each of the bristle tufts 116 comprises a plurality of bristles that extend together from a single tuft hole formed into the head 120 (or head plate). In embodiments that use elastomeric elements as one or more of the cleaning elements 115, suitable elastomeric materials may include any biocompatible resilient material suitable for uses in an oral hygiene apparatus. To provide optimum comfort as well as cleaning benefits, the elastomeric material of any such tooth or soft tissue engaging elements may have a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used. The cleaning elements 115 may be coupled to the head 120 using any technique known in the art, such as stapling, anchor free tufting, in-mold tufting, AMR, or the like. The invention is not to be limited by the manner in which the cleaning elements 115 are coupled to the head 120 in all embodiments.

As discussed above, in the exemplified embodiment the plurality of cleaning elements 115 extend from the front surface 121 of the head 120. A tongue or soft tissue cleaner (depicted in FIGS. 7A and 7B) may be positioned on the rear surface 122 of the head 120. In the exemplified embodiment, the head 120 is formed integrally with the handle 110 as a single unitary structure using a molding, milling, machining, or other suitable process. However, in other embodiments the handle 110 and the head 120 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. Thus the handle 110 and the head 120 may, in certain embodiments, be formed of any of the rigid plastic materials described above, although the invention is not to be so limited in all embodiments and other materials that are commonly used during toothbrush manufacture may also be used.

Figure 2:
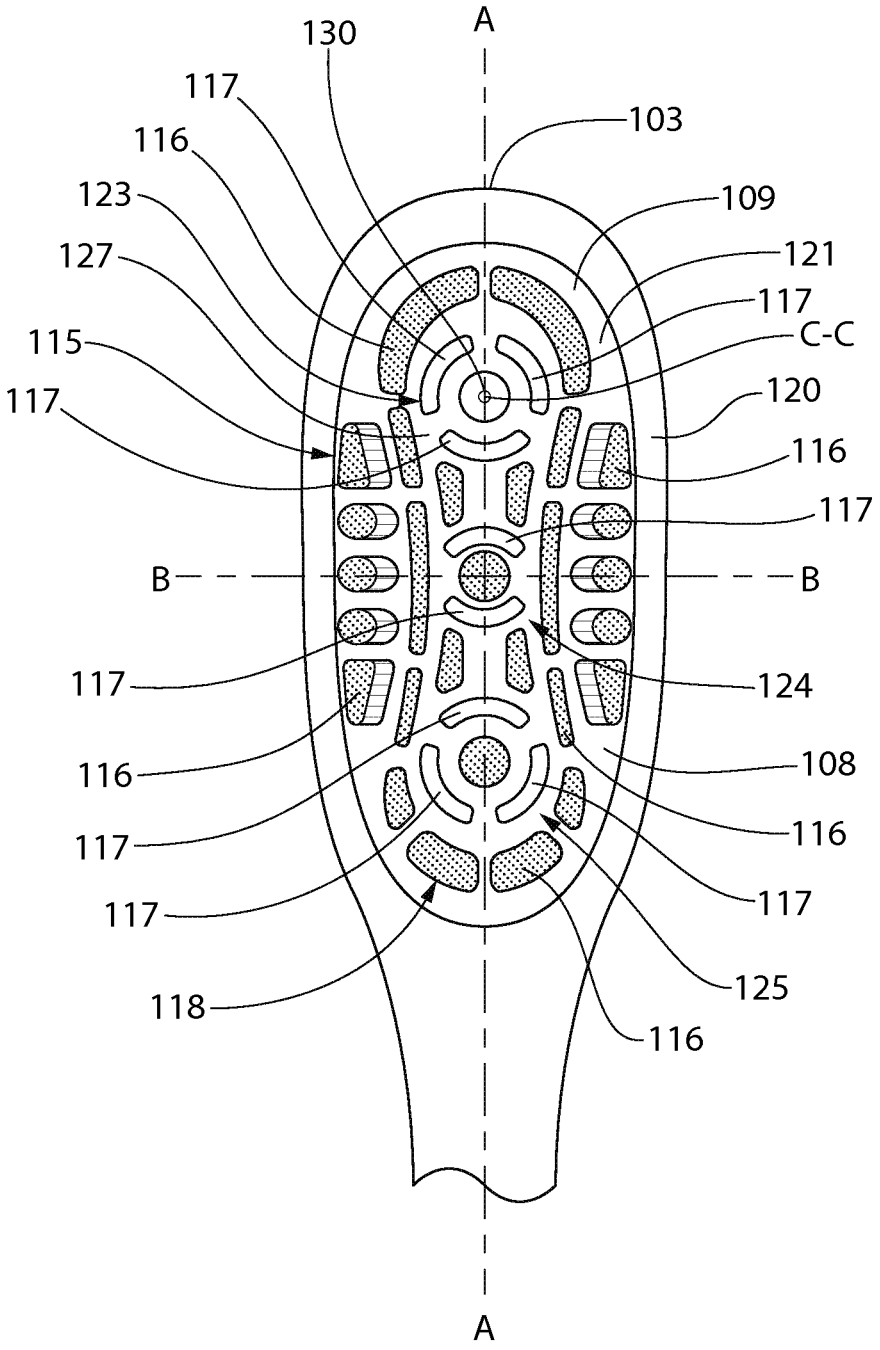
FIG. 2 is a close-up front view of the head of the oral care implement of FIG. 1.

Referring to FIG. 2, the head 120 and the plurality of cleaning elements 115 thereon will be described in more detail. In the exemplified embodiment, the head 120 extends along a longitudinal axis A-A. Furthermore, a transverse axis B-B that is perpendicular to the longitudinal axis A-A divides the head 120 into a proximal region 108 and a distal region 109. In the exemplified embodiment, the movable cleaning element 130 is positioned within the distal region 109 of the head 120. However, the movable cleaning element 130 is not the distal-most cleaning element on the head 120, but rather there are tooth cleaning elements 118 positioned between the movable cleaning element 130 and the distal end 103 of the head 120. In certain embodiments the movable cleaning element 130 may be deemed embedded within a field of cleaning elements formed by the tooth cleaning elements 118 or surrounded by the tooth cleaning elements 118 (i.e., the bristle tufts 116 and/or the elastomeric elements 117).

In the specific embodiment exemplified, as noted above the plurality of cleaning elements 115 comprises the plurality of tooth cleaning elements 118 that includes bristle tufts 116 and elastomeric elements 117. In the exemplified embodiment the bristle tufts 116 make up most of the plurality of tooth cleaning elements 118 with the exception of three subsets of tooth cleaning elements 118 that form loops 123, 124, 125 positioned along the longitudinal axis A-A of the head 120. In the exemplified embodiment the three subsets of tooth cleaning elements 118 that form the loops 123, 124, 125 are formed by elastomeric elements 117. Of course, the invention is not to be so limited in all embodiments and in certain other embodiments the loops 123, 124, 125 may be formed by bristle tufts instead of elastomeric elements. Furthermore, in alternative embodiments one or more of the tooth cleaning elements 118 illustrated as bristle tufts in the figures could instead be formed of elastomeric elements.

Referring still to FIG. 2, in the exemplified embodiment each of the loops 123, 124, 125 is formed by a plurality of arcuate elastomeric elements 117 that are arranged concentrically around a central axis. Specifically, the loop 123 is formed by three arcuate elastomeric elements 117 that are arranged concentrically about a central axis C-C in a spaced apart manner. Thus, in the exemplified embodiment the loop 123 has gaps 127 therein formed by the spaces between adjacent ones of the arcuate elastomeric elements 117. However, the invention is not to be so limited and in other embodiments the loop 123 may be formed by a single continuous elastomeric element that forms a wall with no gaps therein. In other embodiments such a single continuous elastomeric element may include slits formed therein to increase flexibility of the element.

In the exemplified embodiment, the movable cleaning element 130 is positioned within the loop 123 and extends along the central axis C-C. Thus, in the exemplified embodiment the arcuate elastomeric elements 117 that form the loop 123 surround the movable cleaning element 130. Furthermore, the arcuate elastomeric elements 117 that form the loop 123 are spaced apart from the movable cleaning element 130 about the entirety of the circumference or perimeter of the movable cleaning element 130. During use of the oral care implement 100 to clean a user's teeth in the conventional manner, dentifrice and other cleaning materials and agents may partially fill in the space within the loop 123 between the movable cleaning element 130 and the arcuate elastomeric elements 117. As noted briefly above and discussed in more detail below, the movable cleaning element 130 is capable of moving relative to the head 120 such that the distance between the distal tip of the movable cleaning element 130 and the front surface 121 of the head 120 can be adjusted. As the movable cleaning element 130 is moved upwardly and the distal tip is moved further from the front surface 121 of the head 120, the movable cleaning element 130 will retain and carry some of the dentifrice (or other cleaning material or agent) from within the loop 123 such that it may be applied to a user's interdental spaces during cleaning with the movable cleaning element 130. This will enhance the cleaning effect on the interproximal tooth surfaces during use of the movable cleaning element 130.

The loop 124 is formed by two spaced apart arcuate elastomeric elements 117 and the loop 125 is formed by three spaced apart arcuate elastomeric elements 117. In the exemplified embodiment, each of the loops 124, 125 surrounds a tuft of bristles or a fixed tooth cleaning element. Of course, in other embodiments each of the loops 124, 125 may surround a movable cleaning element, or there may not be any cleaning element within the loops 124, 125. In some embodiments a movable cleaning element may be located within any of one or more of the loops 123, 124, 125. Thus, various modifications to the cleaning element pattern are possible and within the scope of the present application.

Figure 3B:
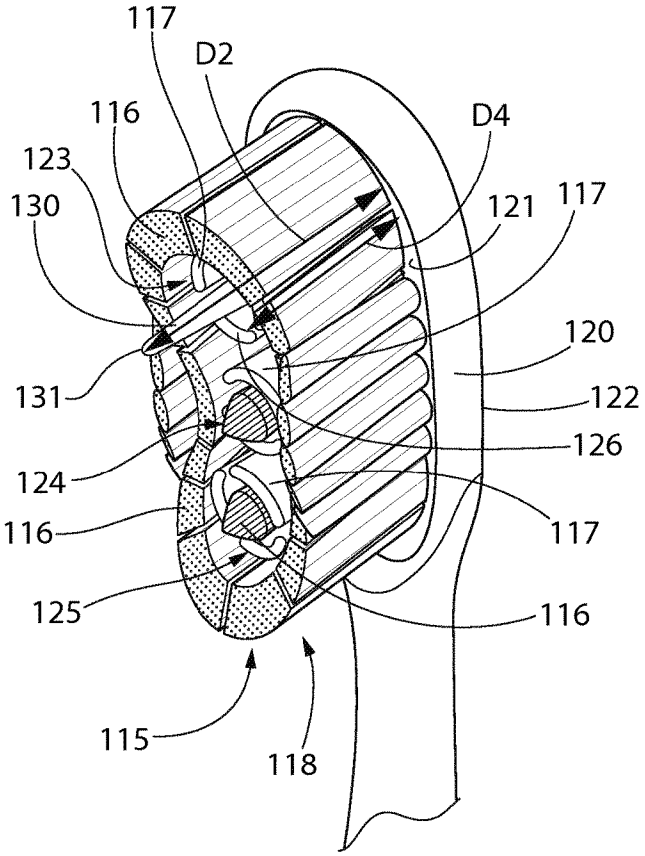
FIG. 3B is a close-up front perspective view of the head of the oral care implement of FIG. 1 with the movable cleaning element in a second position.
Figure 3A:
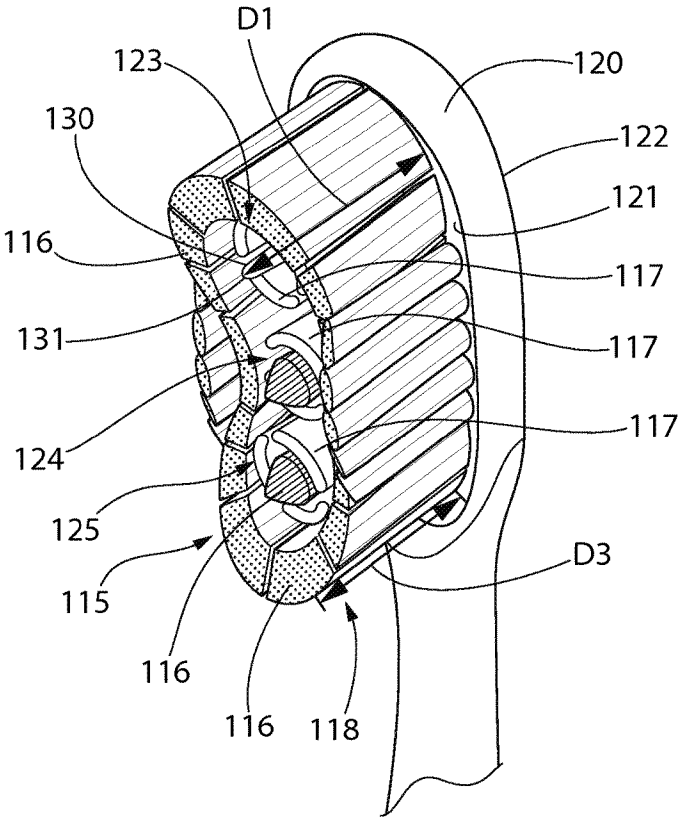
FIG. 3A is a close-up front perspective view of the head of the oral care implement of FIG. 1 with the movable cleaning element in a first position.

Referring to FIGS. 3A and 3B, the movement of the movable cleaning element 130 will be briefly described. In FIG. 3A the movable cleaning element 130 is illustrated in a first position in which a distal tip 131 of the movable cleaning element 130 is spaced a first distance D1 from the front surface 121 of the head 120. In FIG. 3B the movable cleaning element 130 is illustrated in a second position in which the distal tip 131 of the movable cleaning element 130 is spaced a second distance D2 from the front surface 121 of the head 120. In the exemplified embodiment the second distance D2 is greater than the first distance D1. Thus, transitioning the movable cleaning element 130 from the first position to the second position results in the distal tip 131 of the movable cleaning element 130 being located further from the front surface 121 of the head 120. In certain embodiments the movable cleaning element 130 can only be placed into one of the first and second positions. Specifically, in such embodiments the distal tip 131 of the movable cleaning element 130 cannot be maintained at a distance from the front surface 121 of the head 120 that is between the first and second distances D1, D2.

The second distance D2 may be between 2 mm and 10 mm greater than the first distance D1, or between 2 mm and 8 mm greater than the first distance D1, or between 2 mm and 6 mm greater than the first distance D1, or between 2 mm and 4 mm greater than the first distance D1, or the like. In certain embodiments the second distance D2 may be approximately 4 mm greater than the first distance D1 such that the movable cleaning element 130 raises 4 mm when transitioning from the first position to the second position. Of course, the movable cleaning element 130 may raise or extend to distances outside of the ranges provided herein in other embodiments. In one specific embodiment the movable cleaning element 130 extends between 8 mm and 10 mm further from the head in the second position than in the first position.

In the exemplified embodiment, a tallest one of the fixed tooth cleaning elements 118 (the bristle tufts 116 and the elastomeric elements 117) is spaced a third distance D3 from the front surface 121 of the head 120. In this embodiment, the third distance D3 is greater than the first distance D1 and less than the second distance D2. In certain embodiments the second distance D2 is between 2 mm and 5 mm greater than the third distance D3, although the invention is not to be so limited in all embodiments. Furthermore, as discussed above, in the exemplified embodiment the movable cleaning element 130 is located within the loop 123. In this embodiment the loop 123 terminates in a distal surface 126 that is spaced a fourth distance D4 from the front surface 121 of the head 120. In the exemplified embodiment the fourth distance D4 is less than each of the first and second distances D1, D2 such that the movable cleaning element 130 extends further from the front surface 121 of the head 120 than the cleaning elements that form the loop 123 in both the first and second positions. Of course, in other embodiments the fourth distance D4 may be greater than the first distance D1 and less than the second distance D2.

Thus, the movable cleaning element 130 is capable of being moved or adjusted between the first and second positions such that the distance that the distal tip 131 of the movable cleaning element 130 extends from the front surface 121 of the head 120 can be adjusted. In the first position the movable cleaning element 130 extends from the front surface 121 of the head 120 a distance similar to the other cleaning elements 115 on the head 120. In the second position the movable cleaning element 130 extends from the front surface 121 of the head 120 a distance that is greater than the distance that any other cleaning element 115 extends. Thus, in the first position the movable cleaning element 130 functions in a similar manner to the other cleaning elements 115 on the head for teeth cleaning or the like. In the second position, the movable cleaning element 130 may be used independently as an interdental cleaner (such as an interproximal pick or brush) to clean the spaces between adjacent ones of a user's teeth (see FIG. 10 for an example of this use).

In order to facilitate the movement of the movable cleaning element 130, the oral care implement 100 comprises an actuator. There are several different mechanisms that may be used to facilitate the movement of the movable cleaning element 130, a few non-limiting examples of which will be described herein below with reference to FIGS. 4A-8B. It should be appreciated that unless specified otherwise in the claims, the actuator can be any mechanism capable of transitioning the movable cleaning element 130 between the first and second positions and it is not limited to the exemplary embodiments provided herein.

Figure 4A:
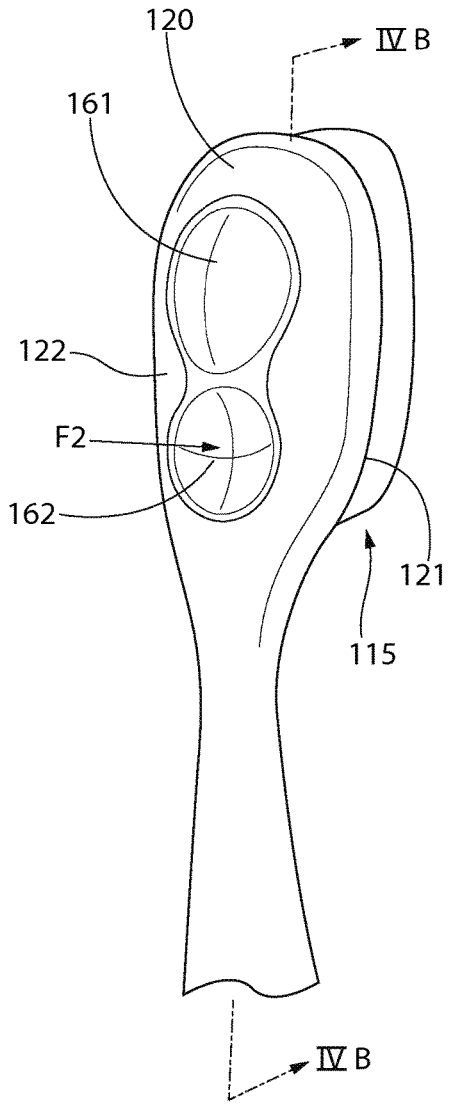
FIG. 4A is a close-up rear perspective view of the head of the oral care implement of FIG. 1 with the movable cleaning element in the first position.
Figure 4B:
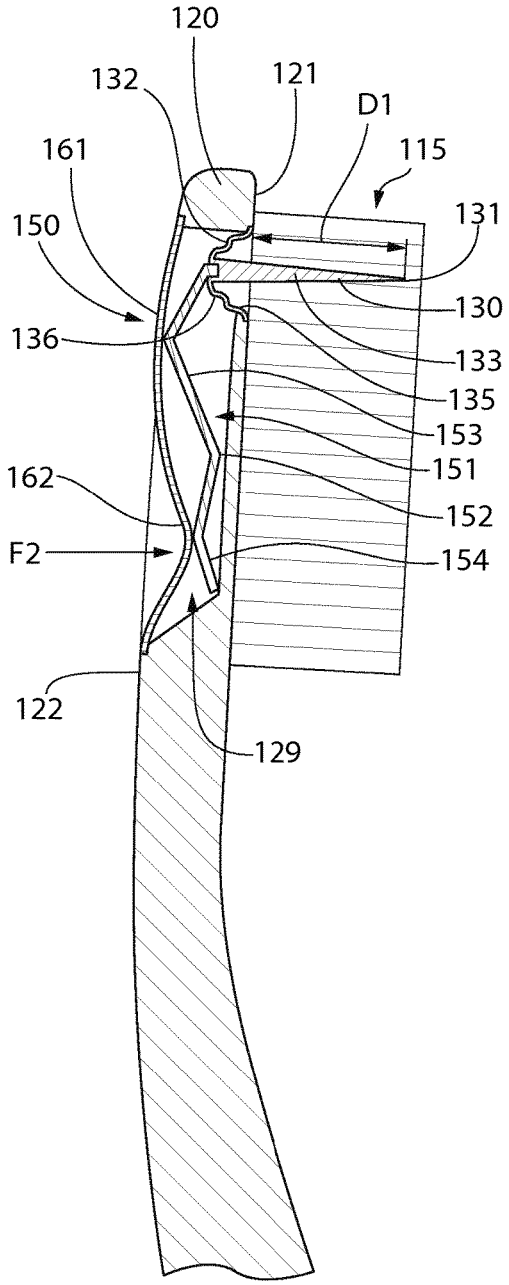
FIG. 4B is a cross-sectional view taken along line IVB-IVB of FIG. 4A.
Figure 5A:
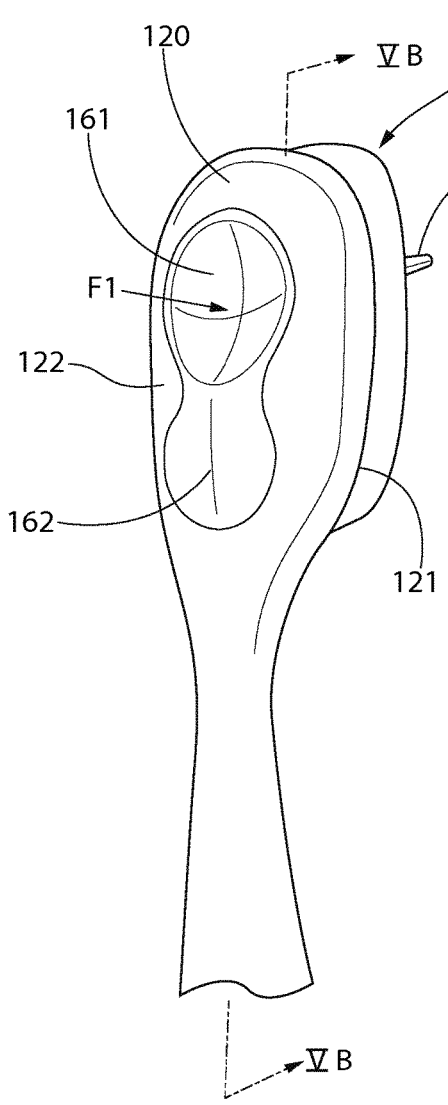
FIG. 5A is a close-up rear perspective view of the head of the oral care implement of FIG. 1 with the movable cleaning element in the second position.
Figure 5B:
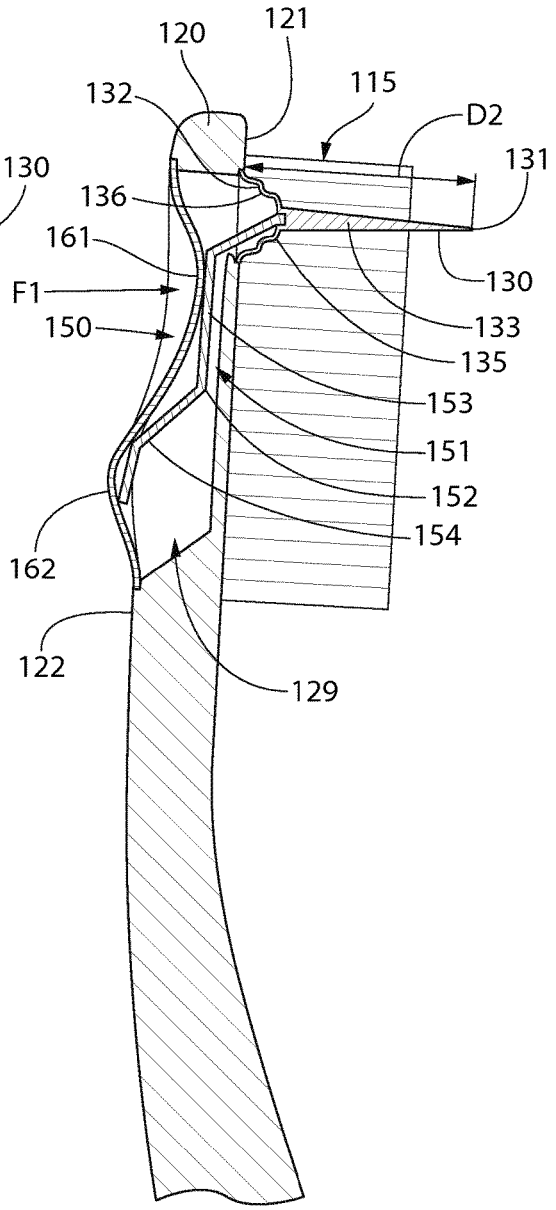
FIG. 5B is a cross-sectional view taken along line VB-VB of FIG. 5A.

Referring to FIGS. 4A-5B, the oral care implement 100 comprises an actuator 150 that facilitates the movement of the movable cleaning element 130 between the first and second positions. FIGS. 4A and 4B illustrate the movable cleaning element 130 in the first position and FIGS. 5A and 5B illustrate the movable cleaning element 130 in the second position. In these embodiments the cleaning elements 115 are generically illustrated it being understood that the description of the cleaning elements 115 above is applicable in certain embodiments. In certain embodiments, actuation of the actuator 150 selectably alters the movable cleaning element 130 between one of the first and second positions. The actuation of the actuator 150 may be referred to herein as an actuation force of the actuator 150. The movable cleaning element 130 may be maintained in each of the first and second positions upon being selected into that position even after cessation of the actuation force of the actuator 150. This functionality may be incorporated into any of the embodiments described herein.

In this embodiment, the head 120 comprises a cavity 129 between the front and rear surfaces 121, 122 thereof. The actuator 150 comprises a switch 151, a first button 160, and a second button 161. In the exemplified embodiment, the switch 151 may be a rocker switch, the details of which are described herein below. However, the invention is not to be so limited in all embodiments and the switch 151 may be any other type of switch including, without limitation, a leaf spring switch, a slide switch, a toggle switch, a thumbwheel switch, a key switch, a tile switch, a rotary switch, a snap action switch, or the like.

In the exemplified embodiment, the switch 151 is positioned within the cavity 129. The switch 151 comprises a pivot point 152, a first leg 153 extending from the pivot point 152 in a first direction, and a second leg 154 extending from the pivot point 152 in a second direction that is opposite the first direction. In the exemplified embodiment, each of the first and second legs 153, 154 is a V-shaped leg having two sections that intersect to form the apex of the V. Of course, the invention is not to be so limited in all embodiments. In the exemplified embodiment the first button 161 is operably coupled to the first leg 153 of the switch 151 and the second button 162 is operably coupled to the second leg 154 of the switch 151. Furthermore, the first leg 153 is operably coupled to the movable cleaning element 130 to facilitate movement of the movable cleaning element 130 as described in greater detail below. In the exemplified embodiment the first leg 153 is directly coupled to the movable cleaning element 130 to facilitate the movement of the movable cleaning element 130.

In the exemplified embodiment, each of the first and second buttons 161, 162 is located on the rear surface 122 of the head 120. Of course, the invention is not to be so limited in all embodiments and the first and second buttons 161, 162 may be located on the neck, on the handle 110, or otherwise in other embodiments. In the exemplified embodiment, the first and second buttons 161, 162 may be formed of an elastomeric material. Furthermore, the first and second buttons 161, 162 form a portion of the boundary of the cavity 129 such that the first and second buttons 161, 162 are exposed at the rear surface 122 of the head 120 to facilitate easy access by a user.

As shown in FIGS. 5A and 5B, as a user presses the first button 161 by applying a force F1 to the first button 161, this causes the first leg 153 of the switch 151 to pivot upwardly about the pivot point 152, which in turn moves the movable cleaning element 130 into the second position due to the operable coupling between the first leg 153 of the switch 151 and the movable cleaning element 130. When in this position, the actuator 150 is considered to be in a second state in certain embodiments.

Similarly, as shown in FIGS. 4A and 4B, as a user presses the second button 162 by applying a force F2 to the second button 162, this causes the second leg 154 of the switch 151 to pivot upwardly about the pivot point 152 due to the operable coupling between the second button 162 and the second leg 154. Simultaneously, this causes the first leg 153 of the switch 151 to pivot downwardly about the pivot point 152, which in turn moves the movable cleaning element 130 into the second position due to the operable coupling between the first leg 153 of the switch 151 and the movable cleaning element 130. When in this position, the actuator 150 is considered to be in a first state in some embodiments.

In certain embodiments, the actuator 150 self-maintains the first and second states (and hence also the first and second positions of the movable cleaning element 130) upon actuation into one of the first and second states until subsequent actuation of the actuator 150 into the other one of the first and second states. Specifically, if a user presses the first button 161, the actuator 150 will be moved into the second state and will remain in the second state until the user presses the second button 162. Similarly, if a user presses the second button 162, the actuator 150 will be moved into the first state and will remain in the first state until the user presses the first button 161. Once in either the first state or the second state, the actuator 150 remains in that state without continued actuation of the actuator. Specifically, a user does not need to maintain the first and/or second forces F1, F2 on the first and second buttons 161, 162 to maintain the actuator in its present state. Rather, the actuator 150 remains in the state in which it is placed without any action or force required by the user until the user applies a force to physically actuate the actuator 150 into the other one of its states.

It should be appreciated that in this embodiment the movable cleaning element 130 can only be maintained in the first and second positions with the distal tip 131 located at the first or second distance D1, D2 from the front surface 121 of the head 120. The movable cleaning element 130 cannot be maintained in any other position. Specifically, the movable cleaning element 130 cannot be maintained with the distal tip 131 located at a distance that is less than the first distance D1, greater than the second distance D2, or between the first and second distances D1, D2.

In the exemplified embodiment, the switch 151 operates by moving or rotation about the pivot point 152 in response to user actuation of one of the first and second buttons 161, 162. This is because in the exemplified embodiment the switch 151 is a rocker switch as noted above However, the invention is not to be so limited in all embodiments. In certain embodiments, the switch 151 may be a leaf spring switch that operates such that when a user presses the first button 161 or the second button 162, the first and second legs 153, 154 of the switch 151 flip or invert relative to their current state or position. Specifically, in this embodiment when a user presses the first button 161 the apex of the V of the first leg 153 faces towards the front surface 121 of the head 120 and the apex of the V of the second leg 154 faces towards the rear surface 122 of the head 120. When a user presses the second button 162, the apex of the V of the first leg 153 faces towards the rear surface 121 of the head 120 and the apex of the V of the second leg 154 faces towards the front surface 121 of the head 120.

In either embodiment and in embodiments that use other types of switches such as those disclosed herein above, operation is such that pressing the second button 162 transitions the actuator 150 into the first state such that the movable cleaning element 130 is in the first position and the distal tip 131 of the movable cleaning element 130 is spaced the first distance D1 from the front surface 121 of the head 120. Furthermore, pressing the first button 161 transitions the actuator 150 into the second state such that the movable cleaning element 130 is in the second position and the distal tip 131 of the movable cleaning element 130 is spaced the second distance D2 from the front surface 121 of the head 120.

In the exemplified embodiment, the movable cleaning element 130 is coupled directly to the head 120 in both the first and second positions. Specifically, with reference to FIGS. 4B and 5B, in the exemplified embodiment the movable cleaning element 130 comprises a base portion 132 and a cleaning portion 133 extending therefrom. In certain embodiments one or both of the base portion 132 and the cleaning portion 133 may be formed of a thermoplastic elastomer. The base portion 132 is coupled directly to the head 120 and has a top surface 135 from which the cleaning portion 133 extends and an opposite bottom surface 136. When the movable cleaning element 130 is in the second position the top surface 135 of the base portion 132 forms an outer surface of the base portion 132. Furthermore, in this position a portion of the base portion 132 extends from the front surface 121 of the head 120 (in the exemplified embodiment a majority of the base portion 132 extends from the front surface 121 of the head 120 in the second position). When the movable cleaning element 130 is in the first position the bottom surface 136 of the base portion 132 forms the outer surface of the base portion 132 and no portion of the base portion 132 protrudes from the front surface 121 of the head 120. Furthermore, in this position a portion of the cleaning portion 133 of the movable cleaning element 130 is positioned within the cavity 129 of the head 120 formed between the front and rear surfaces 121, 122 of the head 120. Thus, when the movable cleaning element 130 transitions between the first and second positions, the base portion 132 of the movable cleaning element 130 flips or inverts. To provide clarity to this description, when the base portion 132 of the movable cleaning element 130 flips or inverts, the inner surface of the base portion 132 becomes the outer surface and the outer surface of the base portion 132 becomes the inner surface.

In certain embodiments, the base portion 132 of the movable cleaning element 130 has a biasing force in both the first and second positions to facilitate maintaining the movable cleaning element 130 in the first and/or second position until an external force is applied thereto to change the position. Thus, when the movable cleaning element 130 is in the first position illustrated in FIG. 4B, the base portion 132 is biased into the downward position and remains in that position until a user presses the first button 161 with sufficient force to flip the base portion 132 of the movable cleaning element 130 as described above to transition the movable cleaning element 130 into the second positon. The movable cleaning element 130 then remains in the second position due to the biasing force of the base portion 132 until a user presses the second button 162 with sufficient force to flip the base portion 132 of the movable cleaning element 130 as described above to transition the movable cleaning element 130 into the first position. The movable cleaning element 130 may maintain a selected position without continued actuation of the actuator 150. Thus, it may be the actuator 150 or the movable cleaning element 150 that maintains the first and second positions until physically altered by force.

In the embodiment illustrated in FIGS. 4A-5B, the movable cleaning element 130 is a single element that is used for interdental cleaning. Thus, in the exemplified embodiment the movable cleaning element 130 tapers along its length such that the cross-sectional area of the movable cleaning element 130 decreases with increasing distance from the front surface 121 of the head 120. In certain embodiments the movable cleaning element 130 may taper along a portion of its length and in other embodiments the movable cleaning element 130 may taper along its entire length.

Figure 9A:
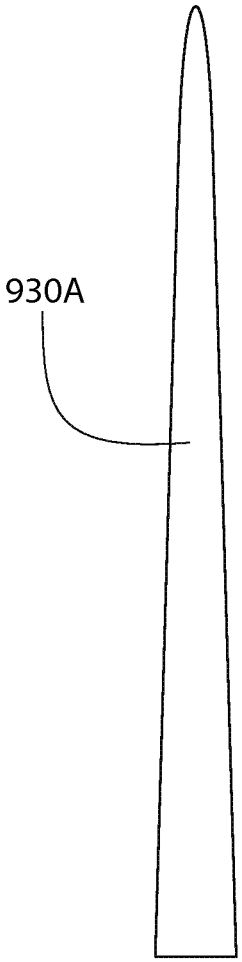
FIG. 9A is a close-up view of a movable cleaning element in accordance with one embodiment of the present invention.
Figure 9B:
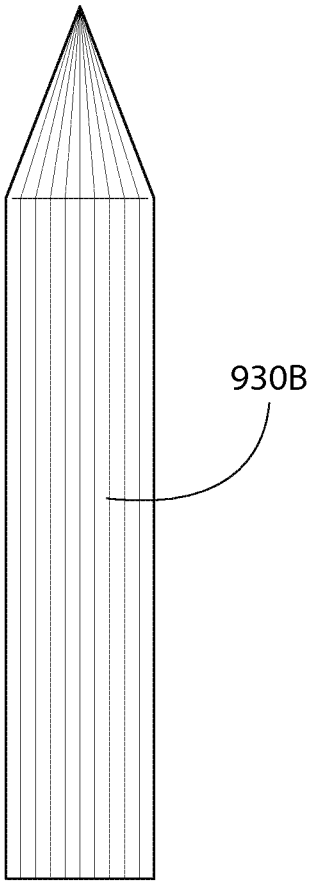
FIG. 9B is a close-up view of the movable cleaning element in accordance with another embodiment of the present invention.

In certain embodiments the movable cleaning element 130 may be formed of a thermoplastic elastomer such as the movable cleaning element 930A illustrated in FIG. 9A. In other embodiments the movable cleaning element 130 may be formed by a single tuft of bristles, such as the tuft of bristles 930B illustrated in FIG. 9B. The tuft of bristles 930B has a tapered distal end, but may be tapered along its entire length in some embodiments. In still other embodiments the movable cleaning element 130 may be formed of other materials depending on the desired operation. Specifically, the movable cleaning element 130 may be formed of a wire with bristles extending therefrom similar to existing interproximal brushes or the movable cleaning element 130 may be formed of a hard plastic material similar to existing interdental picks. However, forming the movable cleaning element 130 from a thermoplastic elastomer or as a tuft of bristles is desirable in certain embodiments to enable safe and effective use of the oral care implement 100 when the movable cleaning element is in the first position and the cleaning elements 115 are being used to clean a user's teeth and other oral surfaces. Furthermore, in some embodiments the movable cleaning element 130 may be formed of more than one tuft of bristles, more than one thermoplastic element, or the like. Thus, the movable cleaning element 130 is not limited to be a single element in all embodiments.

Figure 6A:
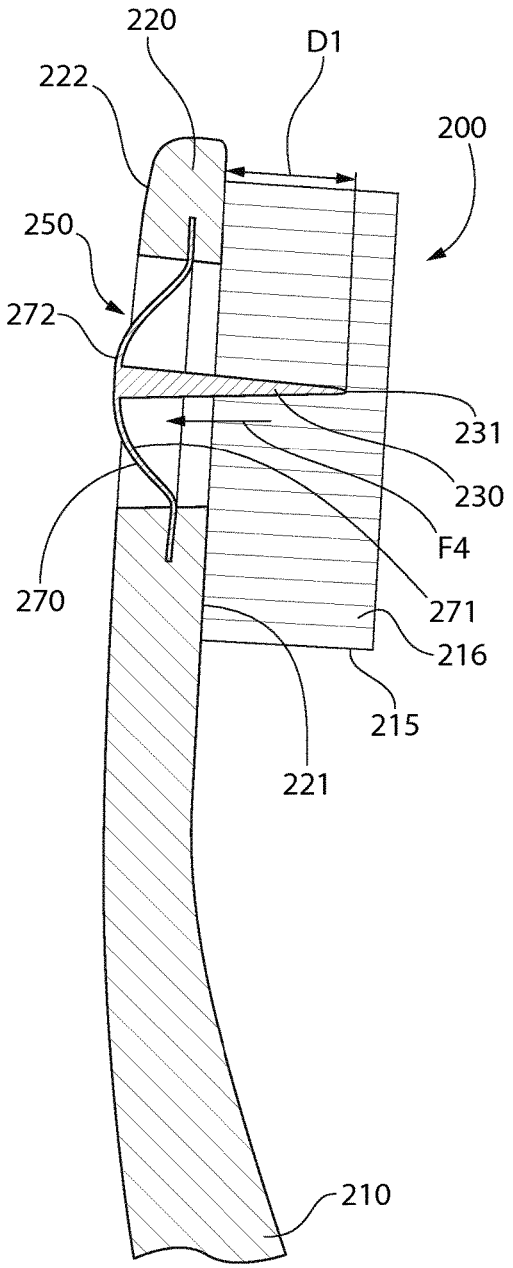
FIG. 6A is a cross-sectional view taken along line IVB-IVB of FIG. 4A in accordance with a first alternative embodiment of the present invention.
Figure 6B:
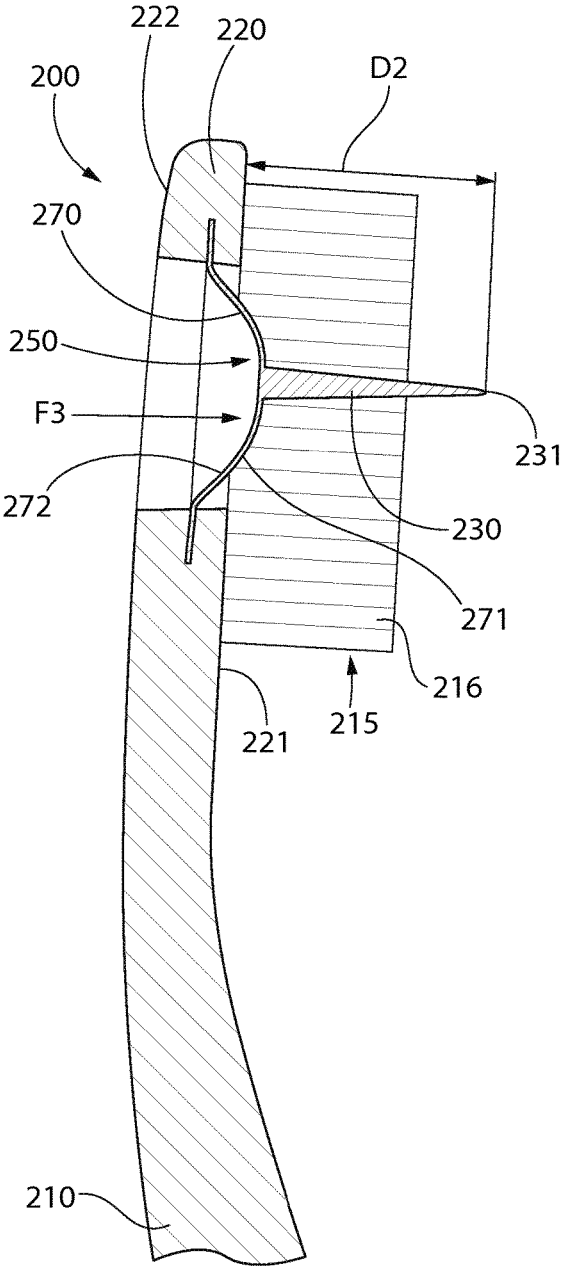
FIG. 6B is a cross-sectional view taken along line VB-VB of FIG. 5A in accordance with a first alternative embodiment of the present invention.

Referring to FIGS. 6A and 6B, an alternative embodiment of an oral care implement 200 will be described in accordance with the present invention. The oral care implement is identical to the oral care implement 100 described above except for the differences specifically noted below. Thus, certain features of the oral care implement 200 will be numbered similarly to the similar features of the oral care implement 100 except that the 100-series of numbers will be used. For features that are numbered but not described, the description of the similar feature with regard to the oral care implement 100 is applicable.

The oral care implement 200 has a handle 210 and a head 220, the head 220 having a front surface 221 and an opposite rear surface 222. A plurality of cleaning elements 215 extend from the front surface 221 of the head 220 and include a plurality of tooth cleaning elements 216 and at least one movable cleaning element 230. The plurality of tooth cleaning elements 216 may be bristle tufts, lamella formed of an elastomeric material, or the like as described above. The at least one movable cleaning element 230 may be an interdental cleaning element formed of a bristle tuft, an elastomeric material, or the like.

The main difference between the oral care implement 200 and the oral care implement 100 is in the actuator 250. Specifically, in this embodiment the actuator 250 comprises a compressible dome 270 that is coupled to the movable cleaning element 230. The compressible dome 270 and the movable cleaning element 230 may be formed as a single integral structure or may be formed separately and coupled together using techniques readily used by persons skilled in the art. The compressible dome 270 has a top surface 271 from which the movable cleaning element 230 extends and an opposite bottom surface 272.

In FIG. 6A, the movable cleaning element 230 is in the first position such that a distal tip 231 of the movable cleaning element 230 is spaced the first distance D1 from the front surface 221 of the head 220. When the movable cleaning element 230 is in the first position, the bottom surface 272 of the compressible dome 270 takes on a convex shape. Furthermore, in the exemplified embodiment when the movable cleaning element 230 is in the first position a portion of the bottom surface 272 of the compressible dome 270 protrudes from/beyond the rear surface 222 of the head 220. In this position the actuator 250 may be deemed to be in the first state. In FIG. 6B, the movable cleaning element 230 is in the second position such that the distal tip 231 of the movable cleaning element 230 is spaced the second distance D2 from the front surface 221 of the head 220. When the movable cleaning element 230 is in the second position, the top surface 271 of the compressible dome 270 takes on a convex shape. Furthermore, in the exemplified embodiment when the movable cleaning element 230 is in the second position a portion of the top surface 271 of the compressible dome 270 protrudes from/beyond the front surface 221 of the head 220. In this position the actuator 250 may be deemed to be in the second state.

To transition the movable cleaning element 230 between the first and second positions (and to similarly transition the actuator 250 between the first and second states), a user presses directly on the compressible dome 270. Specifically, to move the movable cleaning element 230 from the first position to the second position, a user applies a force F3 onto the bottom surface 272 of the compressible dome 270 sufficient to invert the compressible dome 270 and make the movable cleaning element 230 extend the second distance D2 from the front surface 221 of the head 220. To move the movable cleaning element 230 from the second position back to the first position, a user applies a force F4 onto the top surface 271 of the compressible dome 270 sufficient to invert the compressible dome 270 and make the movable cleaning element 230 extend the first distance D1 from the front surface 221 of the head 220.

Similar to the discussion above, the movable cleaning element 230 maintains the first and second positions and/or the actuator 250 maintains the first and second states. Thus, once the actuator 250 is actuated into the first state (FIG. 6A), the actuator 250 remains in the first state even when the force F4 ceases to be applied to the top surface 271 of the compressible dome 270. The actuator 250 remains in the first state until the force F3 is applied to the bottom surface 272 of the compressible dome 270, which transitions the actuator 250 into the second state and the movable cleaning element 230 into the second position. Once in the second state, the actuator 250 remains in the second state even after the force F3 ceases and until the force F4 is applied again to the top surface 271 of the compressible dome 270.

Figure 7A:
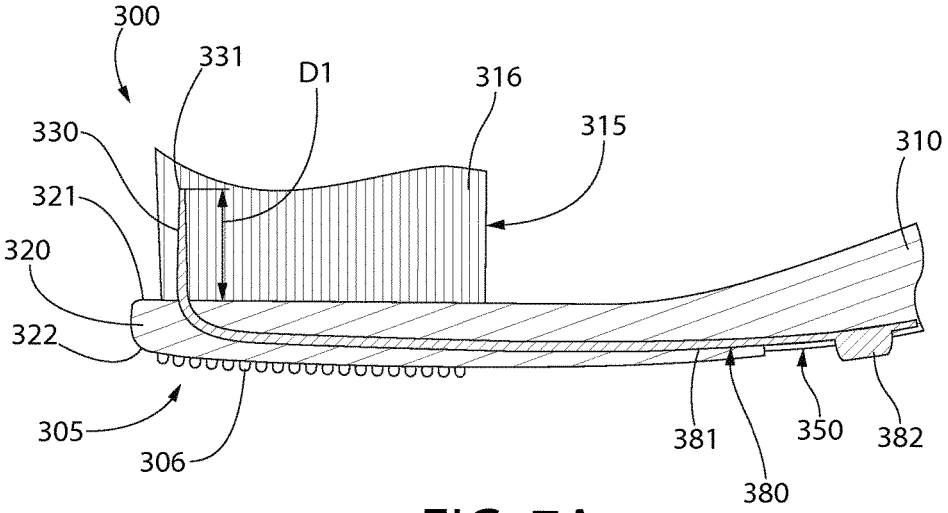
FIG. 7A is a cross-sectional view taken along line IVB-IVB of FIG. 4A in accordance with a second alternative embodiment of the present invention.
Figure 7B:
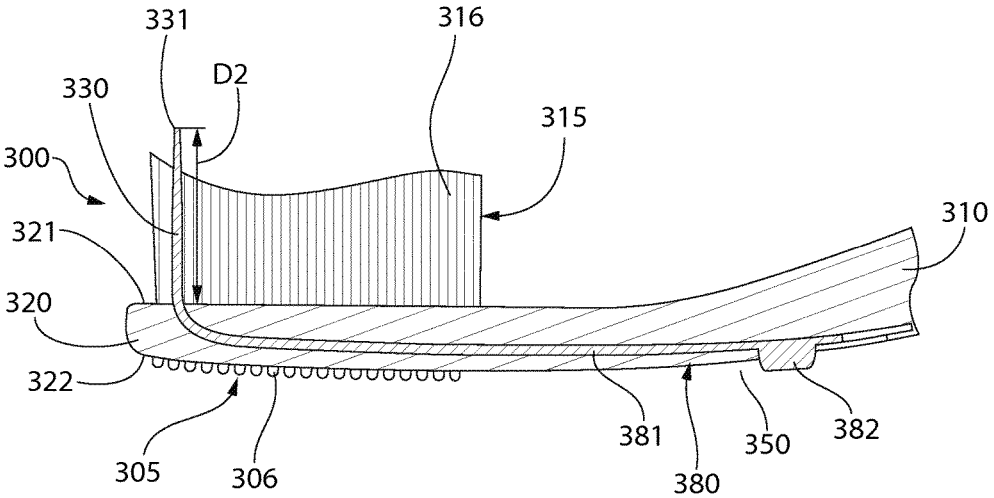
FIG. 7B is a cross-sectional view taken along line VB-VB of FIG. 5A in accordance with a second alternative embodiment of the present invention.

Referring to FIGS. 7A and 7B, an alternative embodiment of an oral care implement 300 will be described in accordance with the present invention. The oral care implement 300 is identical to the oral care implement 100 described above except for the differences specifically noted below. Thus, certain features of the oral care implement 300 will be numbered similarly to the similar features of the oral care implement 100 except that the 300-series of numbers will be used. For features that are numbered but not described, the description of the similar feature with regard to the oral care implement 100 is applicable.

The oral care implement 300 comprises a handle 310 and a head 320, the head 320 having a front surface 321 and an opposing rear surface 322. A plurality of cleaning elements 315 extend from the front surface 321 of the head 320. The plurality of cleaning elements 315 include a plurality of tooth cleaning elements (or fixed cleaning elements) 316 and at least one movable cleaning element 330. Furthermore, in this embodiment a soft tissue cleaner 305 is illustrated affixed to the rear surface 322 of the head 320. The soft tissue cleaner 305 may be an injection molded elastomeric material that is affixed to the rear surface 332 of the head 320 in any desired manner. In the exemplified embodiment the soft tissue cleaner 305 comprises a plurality of protrusions or nubs 306 that extend from the rear surface 322 of the head 320 for cleaning the tongue and other soft tissue surfaces in a user's mouth. It is noted that a soft tissue cleaner such as the soft tissue cleaner 305 may be affixed to the rear surfaces of the heads of the oral care implements in any embodiment described herein.

The oral care implement 300 comprises an actuator 350 that is operably coupled to the movable cleaning element 330 to move the movable cleaning element 330 between the first and second positions as described herein above. However, the actuator 350 is different than the previously described actuators. Specifically, the actuator 350 comprises a slide mechanism 380 that includes a slider 381 and an actuation mechanism 382. The slider 381 of the slide mechanism 380 is operably coupled to the movable cleaning element 330 to facilitate movement of the movable cleaning element 330 as described above and again below. In the exemplified embodiment the slider 381 is illustrated as forming an integral unitary structure with the movable cleaning element 330. However, the invention is not to be so limited and the slider 381 may be a separate component than the movable cleaning element 330 that is operably coupled to the movable cleaning element 330 using a mechanism connection such as lock/key, protuberance/detent, threaded screws, adhesive, fasteners, or the like. The actuation mechanism 382 is a portion of the slide mechanism 380 that protrudes from an outer surface of the oral care implement 300 (either from the outer surface of the head 320 or the outer surface of the handle 310) such that a user can grip the actuation mechanism 382 to slide the slider 381, thereby transitioning the movable cleaning element 330 between the first and second positions.

FIG. 7A illustrates the actuator 350 in a first state such that the movable cleaning element 330 is in a first position whereby a distal tip 331 of the movable cleaning element 330 is spaced a first distance D1 from the front surface 321 of the head 320. FIG. 7B illustrates the actuator 350 in a second state such that the movable cleaning element 330 is in a second position whereby the distal tip 331 of the movable cleaning element 330 is spaced a second distance D2 from the front surface 321 of the head 320, the second distance D2 being greater than the first distance D1. Movement between the first and second states occurs by a user gripping the actuation mechanism 382 and sliding the slider 381 towards the distal end of the head 320 (to transition from the first state/position into the second state/position) and sliding the slider 381 away from the distal end of the head 320 (to transition from the second state/position into the first state/position).

Figure 8A:
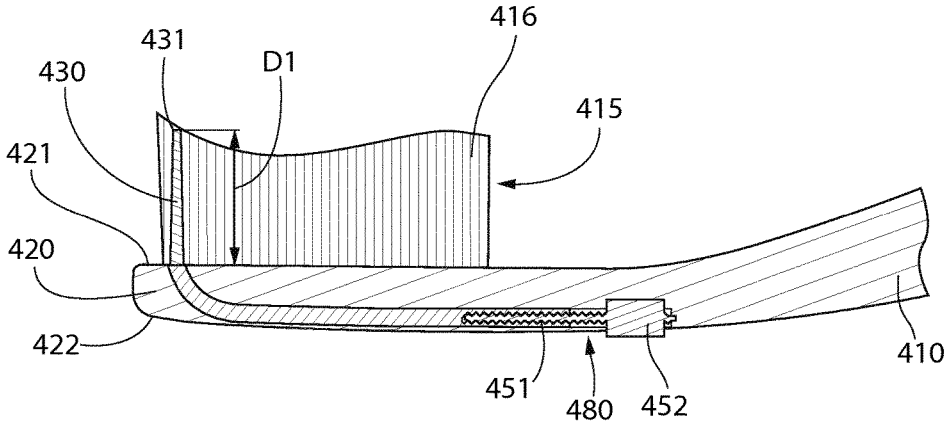
FIG. 8A is a cross-sectional view taken along line IVB-IVB of FIG. 4A in accordance with a third alternative embodiment of the present invention.
Figure 8B:
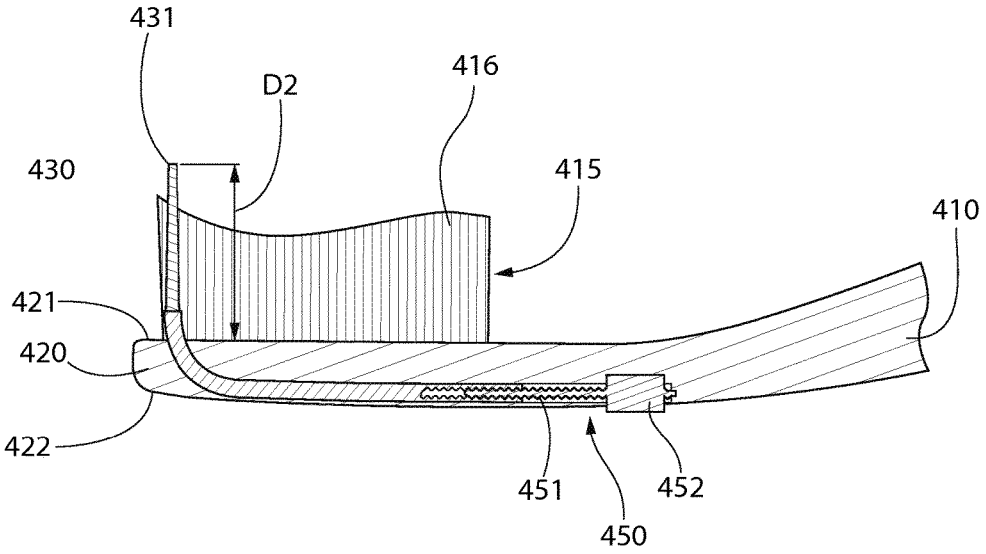
FIG. 8B is a cross-sectional view taken along line VB-VB of FIG. 5A in accordance with a third alternative embodiment of the present invention.

Referring to FIGS. 8A and 8B, an alternative embodiment of an oral care implement 400 will be described in accordance with the present invention. The oral care implement 400 is identical to the oral care implement 100 described above except for the differences specifically noted below. Thus, certain features of the oral care implement 400 will be numbered similarly to the similar features of the oral care implement 100 except that the 400-series of numbers will be used. For features that are numbered but not described, the description of the similar feature with regard to the oral care implement 100 is applicable.

The oral care implement 400 comprises a handle 410 and a head 420, the head 420 having a front surface 421 and an opposing rear surface 422. A plurality of cleaning elements 415 extend from the front surface 421 of the head 420. The plurality of cleaning elements 415 include a plurality of tooth cleaning elements (or fixed cleaning elements) 416 and at least one movable cleaning element 430.

The main difference between the oral care implement 400 and those previously described is with regard to the actuator 450. Specifically, in the oral care implement 400 the actuator 450 comprises a threaded rod 451 and a rotation mechanism 452. The threaded rod 451 is operably coupled to threads of the movable cleaning element 430. In the exemplified embodiment the threaded rod 451 has male threads and the movable cleaning element 430 has female threads, although the opposite arrangement is certainly within the scope of this application. In this embodiment, a user rotates the rotation mechanism 452 which causes the movable cleaning element 430 to move. Specifically, rotating the rotation mechanism 452 in a first rotational direction causes the distal tip 431 of the movable cleaning element 430 to move further away from the front surface 421 of the head 420 until it achieves the second position whereby the distal tip 431 is spaced the second distance D2 from the front surface 421 of the head 420 (FIG. 8B). Rotating the rotation mechanism 452 in a second rotational direction opposite the first rotational direction causes the distal tip 431 of the movable cleaning element 430 to move closer to the front surface 421 of the head 420 until it achieves the first position whereby the distal tip 431 is spaced the first distance D1 from the front surface 421 of the head 420 (FIG. 8A).

In the exemplified embodiment, the rotation mechanism 452 is located on the handle 410 or neck portion of the oral care implement 400. Of course, the invention is not to be so limited and the rotation mechanism 452 may be positioned on the rear surface 421 of the head 420 or the oral care implement 400 or at other locations along the oral care implement 400 as desired.

Figure 10:
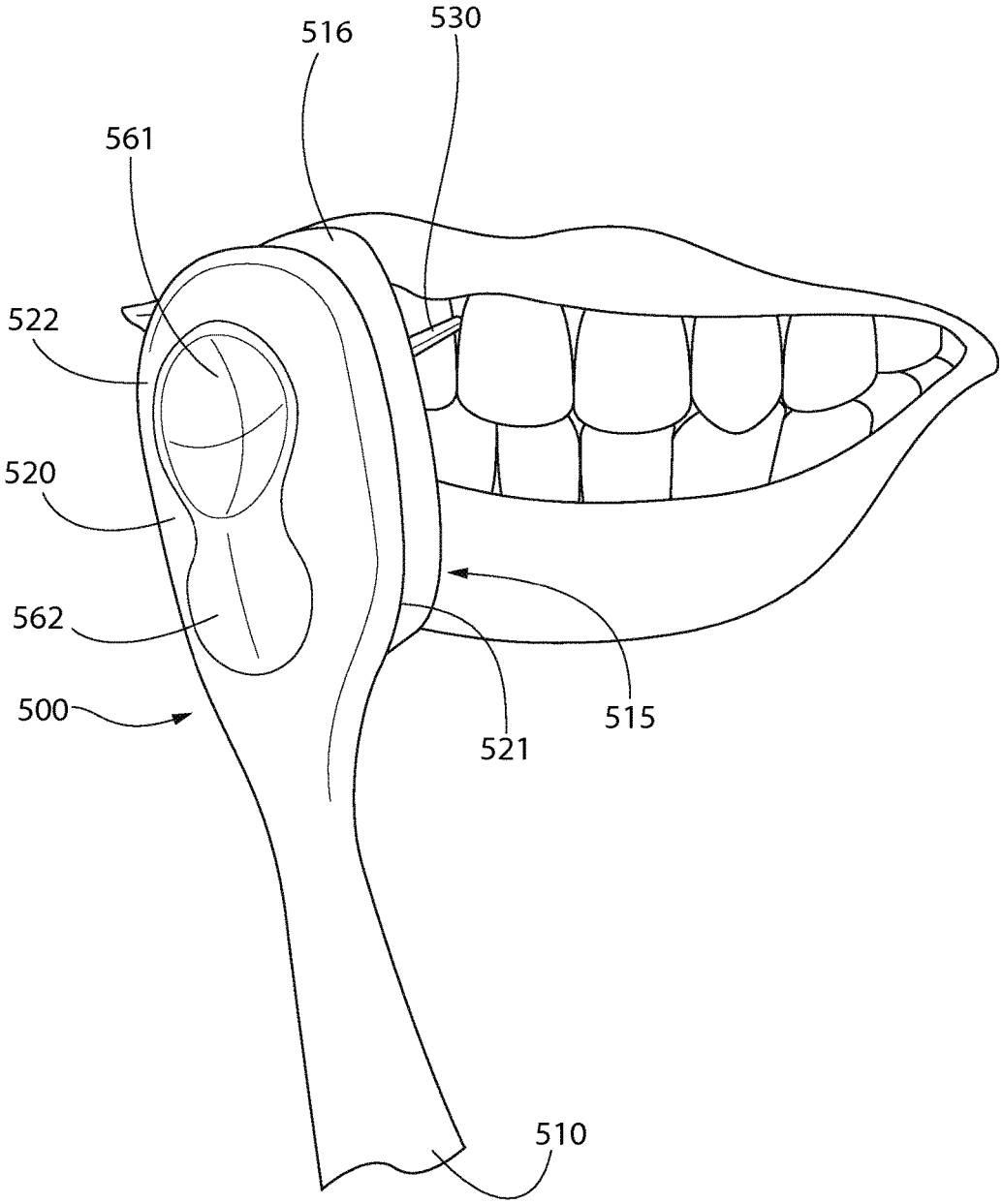
FIG. 10 is a schematic representation of an oral care implement in accordance with the present invention being used to clean the spaces between a user's teeth.

Referring briefly to FIG. 10, an oral care implement 500 is illustrated in use. The oral care implement 500 is similar to the oral care implement 100 described above with reference to FIGS. 1-5B, and thus similar numbering will be used except the 500-series of numbers will be used. The oral care implement 500 generally comprises a handle 510 and a head 520. The head 520 has a front surface 521 and an opposite rear surface 522. A plurality of cleaning elements 515 extend from the front surface 521 of the head 520 and include a plurality of fixed cleaning elements or tooth cleaning elements 516 and at least one movable cleaning element 530. The movable cleaning element 530 is movable or adjustable between a first position in which the movable cleaning element 530 extends the first distance D1 from the front surface 521 of the head 520 and a second position in which the movable cleaning element 530 extends the second distance D2 from the front surface 521 of the head 520. Adjusting the movable cleaning element 530 between the first and second positions is achieved by separately pressing first and second buttons 561, 562 located on the rear surface 521 of the head 520 (similar to the description of FIGS. 4A-5B above). The movable cleaning element 530 is illustrated in the second position in FIG. 10.

When the movable cleaning element 530 is in the second position, the movable cleaning element 530 extends further from the front surface 521 of the head 520 than any of the other cleaning elements 516 on the head 520. Thus, in this position the movable cleaning element 530 is used as an interdental brush or pick to clean the spaces between a user's teeth as illustrated in FIG. 10. When desired to brush teeth with the oral care implement 500, the second button 562 is pressed, which causes the movable cleaning element 530 to transition into the first position (see FIGS. 4A and 4B). In the first position the movable cleaning element 530 does not extend further from the front surface 521 of the head 520 than the other cleaning elements 516 on the head.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An oral care implement comprising:

a handle and a head, the head having a front surface and an opposing rear surface;

a plurality of cleaning elements extending from the front surface of the head, the plurality of cleaning elements comprising a plurality of fixed tooth cleaning elements and a movable interdental cleaning element;

an actuator operably coupled to the movable interdental cleaning element to move the movable interdental cleaning element between: (1) a first position in which a distal tip of the movable interdental cleaning element is spaced a first distance from the front surface of the head; and (2) a second position in which the distal tip of the movable interdental cleaning element is spaced a second distance from the front surface of the head, the second distance being greater than the first distance;

wherein actuation of the actuator selectably alters the movable interdental cleaning element between one of the first and second positions, the movable interdental cleaning element being maintained in each of the first and second positions upon being selected after cessation of an actuation force of the actuator;

the actuator comprising a switch and first and second buttons, the switch having a pivot point and first and second legs extending from the pivot point in opposite directions, the first button operably coupled to the first leg and the second button operably coupled to the second leg, the first leg being operably coupled to the movable interdental cleaning element;

wherein pressing the first button causes the first leg of the switch to pivot upwardly about the pivot point thereby transitioning the movable interdental cleaning element into the second position; and wherein pressing the second button causes the first leg of the switch to pivot downwardly about the pivot point thereby transitioning the movable interdental cleaning element into the first position.

2. The oral care implement according to claim 1 wherein the actuator is in a first state when the movable interdental cleaning element is in the first position and the actuator is in a second state when the movable interdental cleaning element is in the second position, and wherein the actuator self-maintains the first and second states upon actuation into the first and second states until subsequent actuation of the actuator into the other one of the first and second states.

3. The oral care implement according to claim 1 wherein the movable interdental cleaning element is a single element formed of an elastomeric material or a single tuft of bristles.

4. The oral care implement according to claim 1 wherein a subset of the plurality of fixed tooth cleaning elements are arranged in a loop about a central axis, the movable interdental cleaning element being positioned within the loop and extending along the central axis.

5. The oral care implement according to claim 4 wherein the subset of the plurality of fixed tooth cleaning elements that are arranged in the loop are formed of an elastomeric material or one or more bristle tufts.

6. The oral care implement according to claim 4 wherein the subset of the plurality of fixed tooth cleaning elements comprises two or more arcuate tooth cleaning elements that are spaced apart along the head such that the loop forms a discontinuous wall that substantially surrounds the movable interdental cleaning element.

7. The oral care implement according to claim 1 wherein a tallest one of the fixed tooth cleaning elements is spaced a third distance from the front surface of the head, and wherein the first distance is less than or equal to the third distance and the second distance is greater than the third distance.

8. The oral care implement according to claim 1 wherein the distal tip of the movable interdental cleaning element cannot be maintained at a distance from the front surface of the head that is between the first and second distances.

9. An oral care implement comprising:

a handle and a head, the head having a front surface and an opposing rear surface;

a plurality of cleaning elements extending from the front surface of the head, the plurality of cleaning elements comprising a subset of cleaning elements that form a loop and at least one movable cleaning element positioned within the loop;

an actuator operably coupled to the movable cleaning element to move the movable cleaning element between: (1) a first position in which a distal tip of the movable cleaning element is spaced a first distance from the front surface of the head; and (2) a second position in which the distal tip of the movable cleaning element is spaced a second distance from the front surface of the head, the second distance being greater than the first distance;

the actuator comprising a switch and first and second buttons located on the rear surface of the head, the switch having a pivot point and first and second lees extending from the pivot point in opposite directions, the first button operably coupled to the first leg and the second button operably coupled to the second leg, the first lea being operably coupled to the movable cleaning element;

wherein Dressing the first button causes the first lea of the switch to pivot upwardly about the pivot point thereby transitioning the movable cleaning element into the second position; and wherein pressing the second button causes the first leg of the switch to pivot downwardly about the pivot point thereby transitioning the movable cleaning element into the first position.

10. The oral care implement according to claim 9 wherein the subset of cleaning elements that form the loop are formed of an elastomeric material.

11. The oral care implement according to claim 9 wherein the subset of cleaning elements that form the loop comprises two or more arcuate cleaning elements arranged about a central axis in a spaced apart manner so that gaps are formed in the loop between adjacent ones of the arcuate cleaning elements.

12. The oral care implement according to claim 9 wherein the movable cleaning element maintains the first and second positions upon actuation into one of the first and second positions without continued actuation of the actuator and until subsequent actuation of the actuator.

13. The oral care implement according to claim 9 wherein the movable cleaning element is either a single tuft of bristles or a single element formed of an elastomeric material used for interdental cleaning.

14. The oral care implement according to claim 9 wherein the movable cleaning element is coupled directly to the head in both the first and second positions.

15. The oral care implement according to claim 9 wherein the loop terminates in a distal surface that is spaced a fourth distance from the front surface of the head, and wherein the fourth distance is less than each of the first and second distances.

16. The oral care implement according to claim 9 wherein the distal tip of the movable interdental cleaning element cannot be maintained at a distance from the front surface of the head that is between the first and second distances.

* * * * *